US012643631B2

(12) United States Patent
Sun et al.

(10) Patent No.: US 12,643,631 B2
(45) Date of Patent: Jun. 2, 2026

(54) JET-PROPELLED WATER-ENTRY COMPOSITE BUFFER DEVICE FOR MULTI-CHANNEL GAS RECYCLING

(71) Applicant: DALIAN UNIVERSITY OF TECHNOLOGY, Dalian (CN)

(72) Inventors: Tiezhi Sun, Dalian (CN); Yao Li, Dalian (CN); Zhi Zong, Dalian (CN); Di Zhang, Dalian (CN); Shisheng Wang, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 548 days.

(21) Appl. No.: 18/258,370

(22) PCT Filed: Oct. 27, 2022

(86) PCT No.: PCT/CN2022/127976
§ 371 (c)(1),
(2) Date: Jun. 20, 2023

(87) PCT Pub. No.: WO2023/072198
PCT Pub. Date: May 4, 2023

(65) Prior Publication Data

US 2024/0034437 A1 Feb. 1, 2024

(30) Foreign Application Priority Data

Oct. 29, 2021 (CN) ..... 202111275485.1

(51) Int. Cl.
*B63B 1/38* (2006.01)
*B63G 8/00* (2006.01)

(52) U.S. Cl.
CPC ..... *B63B 1/38* (2013.01); *B63G 8/001* (2013.01); *B63B 2001/382* (2013.01)

(58) Field of Classification Search
CPC ..... B63B 1/38; B63B 2001/382; B63G 8/001; Y02T 70/10; B63C 11/52
See application file for complete search history.

(56) References Cited

U.S. PATENT DOCUMENTS 5,955,698 A * 9/1999 Harkins ..... F42B 10/46 102/390
6,405,653 B1 * 6/2002 Miskelly ..... F42B 15/20 89/1.807

(Continued)

FOREIGN PATENT DOCUMENTS

CN 111806174 A 10/2020
CN 112413038 A 2/2021

(Continued)

*Primary Examiner* — Anthony D Wiest
(74) *Attorney, Agent, or Firm* — NKL Law; Allen Xue

(57) ABSTRACT

A jet-propelled water-entry composite buffer device for multi-channel gas recycling includes a head fairing, an underwater vehicle, a buffer, a cavitator and a side fairing. The side fairing is internally provided with a fairing body and a sealing choke plate, and a high-pressure gas cavity, a transition cavity and a sub-high-pressure gas cavity are formed by the fairing body and the sealing choke plate from front to back; a quota air pressure valve is disposed on the sealing choke plate; the fairing body is provided with pressure reducing holes; the high-pressure gas cavity, the transition cavity and the sub-high-pressure gas cavity form an gas cushion buffer. Gas acceleration holes communicated with the high-pressure gas cavity are further provided in the outer wall of the side fairing, so that a supercavity can be more favorably formed after the underwater vehicle enters water.

9 Claims, 9 Drawing Sheets

(56) References Cited

U.S. PATENT DOCUMENTS

| | | | | |
|---|---|---|---|---|
| 6,684,801 | B1 * | 2/2004 | Kuklinski | F42B 19/125<br>114/67 A |
| 6,739,266 | B1 | 5/2004 | Castano et al. | |

FOREIGN PATENT DOCUMENTS

| | | | |
|---|---|---|---|
| CN | 112413040 | A | 2/2021 |
| CN | 113955055 | A | 1/2022 |
| CN | 114013557 | A | 2/2022 |
| CN | 114013614 | A | 2/2022 |
| KR | 102136824 | B1 | 7/2020 |

* cited by examiner

JET-PROPELLED WATER-ENTRY COMPOSITE BUFFER DEVICE FOR MULTI-CHANNEL GAS RECYCLING

TECHNICAL FIELD

The present invention relates to the technical field of water-entry load reduction of an underwater vehicle, particular to a jet-propelled water-entry composite buffer device for multi-channel gas recycling.

BACKGROUND ART

Due to the advantages of strong concealment, not prone to be detected by the enemy and the like, underwater vehicles or near-free surface vehicles are increasingly valued by the military, and using special unmanned underwater vehicles for reconnaissance and attack upon the enemy has become a key means in the future battlefield. In order to meet the combat requirements in modern complex electronic environments, underwater vehicles are increasingly precise and complex in design, while further puts forward high requirements for reliability and stability of the structure. In particular, underwater vehicle launched in the form of air launch is generally subject to a process of water-entry impact. With the changes in the height and speed of air launch, the underwater vehicle is subject to different degrees of head overload. Without proper protection, the underwater vehicle structure may be severely damaged in the process of impacting the water surface. Therefore, how to effectively protect the underwater vehicles from overload caused by water entry has become an important issue in the art. Most of the existing underwater vehicles use hydraulic cylinders and other structures for load reduction, but the load reduction capacity is limited.

SUMMARY

In order to solve the above technical problems, the present invention provides a jet-propelled water-entry composite buffer device for multi-channel gas recycling.

The technical solution used by the present invention is as follows:

A jet-propelled water-entry composite buffer device for multi-channel gas recycling, includes a head fairing, an underwater vehicle, a buffer and a cavitator, where the buffer is configured to buffer the acting force between the underwater vehicle and the water when the underwater vehicle enters the water, and the composite buffer device further includes a side fairing.

The side fairing is a split-type, with a plurality of splits sealing spliced into a whole around the axis of the side fairing, and the plurality of splits are detachably connected with each other. The side fairing includes a fairing side wall, a head part of the underwater vehicle is detachably connected to a rear end of the fairing side wall through electromagnet disposed in the underwater vehicle, and a rear end of the head fairing is detachably connected to a front end of the side fairing. The cavitator is located in the front end of the side wall of the fairing, and the outer edge of the cavitator is in sealing sliding connection with the fairing side wall.

The side fairing further includes a fairing body and a sealing choke plate disposed in the fairing side wall. The sealing choke plate is located at a front end of the fairing body, a transition cavity is formed by the sealing choke plate and the fairing body located in the fairing side wall, a high-pressure gas cavity is formed by the cavitator and the sealing choke plate located in the fairing side wall, the high-pressure gas cavity is provided with high-pressure gas, and a sub-high-pressure gas cavity is formed by the fairing body and a portion of the head part of the underwater vehicle located in the fairing side wall.

The sealing choke plate is provided with a quota air pressure valve, and when the pressure in the high-pressure air cavity exceeds a set value of the quota air pressure valve, the high-pressure gas in the high-pressure gas cavity enters the transition cavity.

Pressure reducing holes with two ends respectively communicated with the transition cavity and the sub-high-pressure gas cavity are provided in the fairing body, and the pressure reducing holes are configured to depressurize and transmit the high-pressure gas in the transition cavity to the sub-high-pressure gas cavity.

An output end of the buffer is located in the high-pressure gas cavity and fixedly connected to the cavitator, and an input end thereof passes through the sealing choke plate and the fairing body and is connected to the underwater vehicle, and is sealing connected to the sealing choke plate and the fairing body.

A side wall jet system is disposed on the fairing side wall and includes a plurality of gas acceleration holes axially arranged on the fairing side wall, a front end of each gas acceleration hole is communicated with a gas diffusion ring disposed on an outer wall of a front end of the fairing side wall, the gas diffusion ring faces the circumferential direction of the side fairing, and a rear end of each gas acceleration hole is communicated with the sub-high pressure gas cavity through a gas acceleration hole one-way valve.

The buffer is provided with an inflation system for inflating the high-pressure gas cavity. The inflation system includes a gas storage tank located in the underwater vehicle, a gas guiding pipeline system disposed in the buffer, and an inflation orifice disposed on the buffer. One end of the inflation orifice is communicated with the gas storage tank through the gas guiding pipeline system, and the other end of the inflation orifice is communicated with the high-pressure gas cavity.

The buffer includes an outer sleeve, and an inner sleeve is disposed in the outer sleeve. A part between the outer sleeve and the inner sleeve forms an oil storage cavity. The inner sleeve is provided with a piston rod, a front end of the piston rod passes through the outer sleeve and the inner sleeve and is fixedly connected with the cavitato, a piston is disposed at a rear end of the piston rod, and a part between the piston and a front end of the inner sleeve is provided with a tension spring sleeved on the piston rod. A rear end of the outer sleeve passed through the sealing choke plate and the fairing body and is fixedly connected with a damper fixing base, and is further connected to the underwater vehicle through the damper fixing base.

The gas guiding pipeline system includes a central vent tube, a front end of the central vent tube sequentially passes through the damper fixing base, a rear end center of the outer sleeve, and a rear end center of the inner sleeve, then penetrates into the piston rod and is in airtight sliding connection with an inner wall of the piston rod. The piston rod is internally provided with a gas buffer cavity, a rear end of the gas buffer cavity is communicated with the front end of the central vent tube through an inflation valve, the gas buffer cavity is provided with a compression spring with and axis coinciding with the axis of the piston rod, and an end surface of the central vent tube abuts against the compression spring. The front end of the piston rod is provided with a gas guiding blind hole communicated with the gas buffer cavity, and the gas guiding blind hole is communicated with an inflation orifice processed on the piston rod. A rear end of the central vent tube is communicated with an outlet of the gas storage tank.

The rear end of each of the gas acceleration holes is communicated with the gas storage tank through a side jet valve.

The pressure reducing holes and gas acceleration holes are all Tesla valve holes, and the Tesla valve holes are arranged in the same direction.

A booster engine is disposed in a tail part of the underwater vehicle, and the tail gas of the booster engine is communicated with an inlet of the gas storage tank through a tail gas collection device.

The tail gas collection device includes a suction fan, a driving device for driving the suction fan to operate, and a fan air guiding hood. The suction fan and the driving device are disposed in the fan air guiding hood. One end of the fan air guiding hood is communicated with an exhaust end of the booster engine through a pipeline and a gas cooling and filtering device, and the other end of the fan air guiding hood is communicated with the inlet of the gas storage tank through a pipeline and a gas intake one-way vent valve. There can be a plurality of tail gas collection devices, each tail gas collection device can be configured with a plurality of suction fans, driving devices and fan air guiding hoods connected in series with each other. Each tail gas collection device can be configured with a gas storage tank. A gas collecting device is disposed in a head part of the underwater vehicle. The gas collecting device is provided with the same number of gas intake passages as the number of gas storage tanks. Inner ends of the gas intake passages are converged at the center of the gas collecting device, outer ends thereof are communicated with the corresponding gas storage tanks. The central vent tube is communicated with the center of the gas collecting device, and each gas storage tank is communicated with one or more gas acceleration holes through pipelines.

Compared with the prior art, the present invention has the following advantages:

1. The present invention adds an air cushion buffer on the basis of traditional buffer (achieved by the pressure reducing hole, the high-pressure gas cavity, the sub-high-pressure gas cavity and the sealing choke plate), which can further protect the head part of the underwater vehicle from being damaged.
2. The present invention further adds a side wall jet system on the basis of traditional buffer, so that supercavity can be more favorably formed after the underwater vehicle enters water.
3. The present invention recycles the tail gas generated by the booster engine, and uses the tail gas for load reduction and supercavity formation.
4. The pressure reducing holes and gas acceleration holes of the present invention are all Tesla valve holes, and the Tesla valve holes are arranged in the same direction. In the present invention, the Tesla valve holes can realize the buffering and pressure reduction of the gas entering from the front end through the pressure reduction hole, and then accelerate the ejection of the gas from the gas acceleration hole, which makes full use of the gas, and combines acceleration and deceleration buffering to achieve the effect of 1+1>2. The Tesla valve holes can accelerate the gas (when the gas moves from the rear end to the front end, in the present invention) or decelerate the gas (when the gas moves from the front end to the rear end, in the present invention) without consuming energy. The structure of the Tesla valve hole is a repetitive unit structure, and the more the structure is repeated over a finite length (the smaller the unit structure), the more obvious the effect on gas acceleration or deceleration will be.

Based on the above reasons, the present invention can be widely applied in the fields of water-entry of underwater vehicles and the like.

BRIEF DESCRIPTION OF THE DRAWINGS

In order to explain technical solutions of embodiments of the present invention or the prior art more clearly, the drawings that need to be used in the embodiments or the prior art will be briefly introduced below. Apparently, the drawings introduced below are only some embodiments of the present invention, and for those ordinarily skilled in the art, other drawings can also be obtained according to these drawings without creative efforts.

Figure 1:
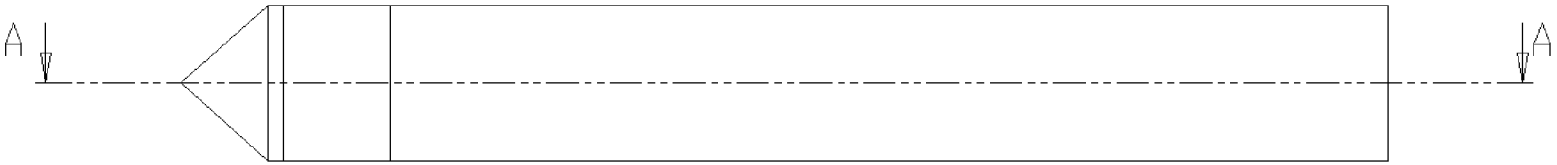
FIG. 1 is a front view of a jet-propelled water-entry composite buffer device for multi-channel gas recycling according to an embodiment of the present invention.
Figure 2:
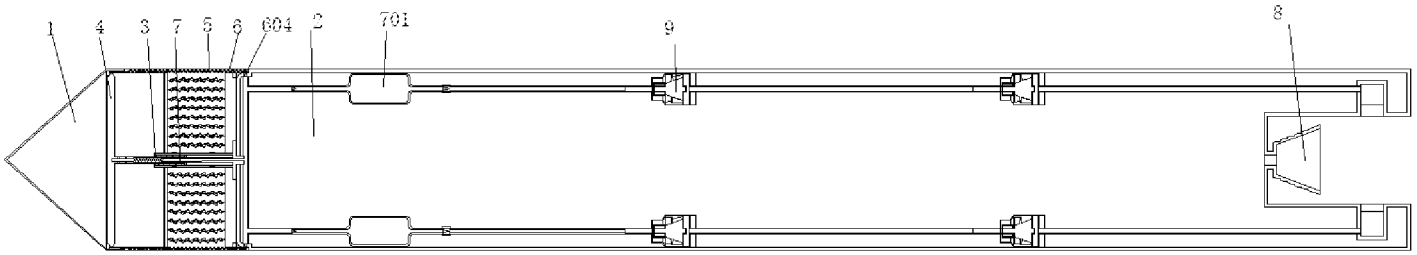
FIG. 2 is an A-A sectional diagram in FIG. 1.
Figure 3:
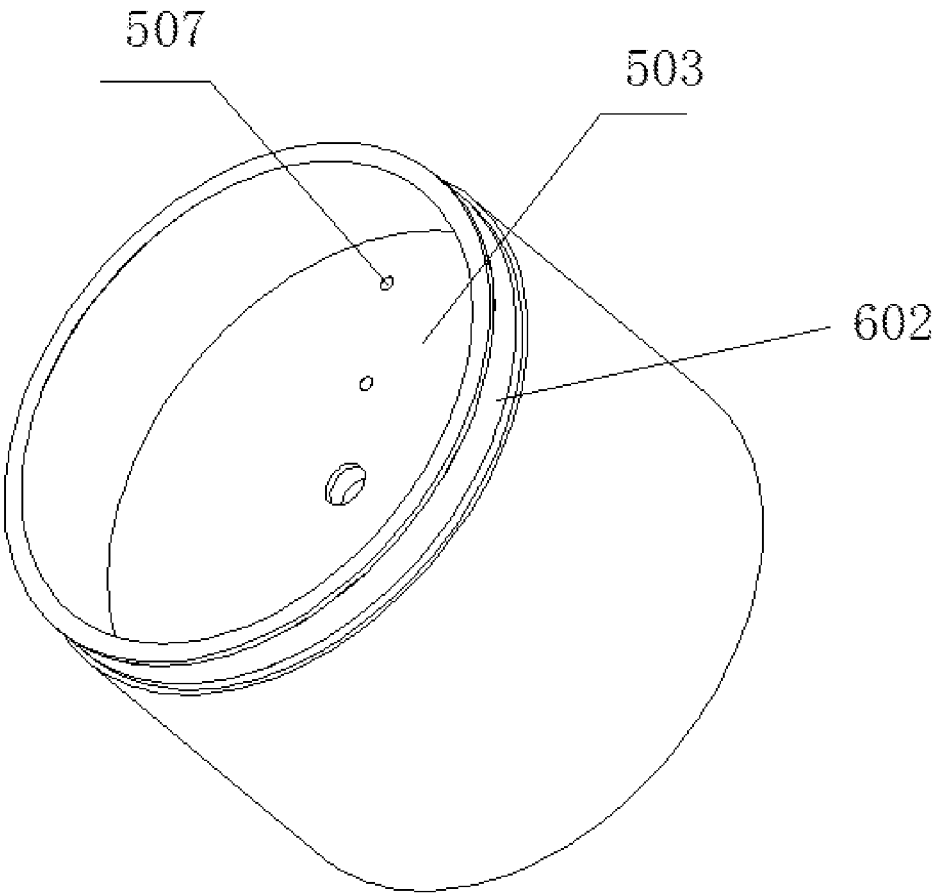
FIG. 3 is a three-dimensional view of a side fairing according to an embodiment of the present invention.
Figure 4:
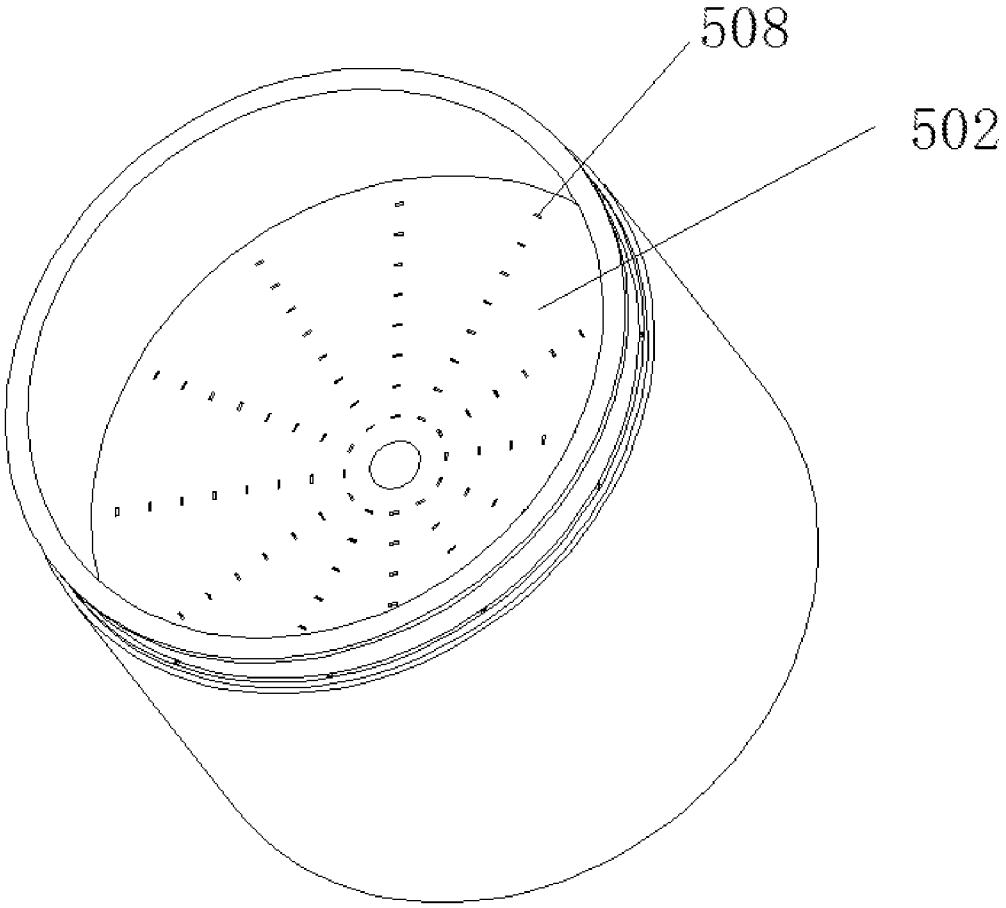
FIG. 4 is a three-dimensional view of the side fairing removing a sealing choke plate according to an embodiment of the present invention.
Figure 5:
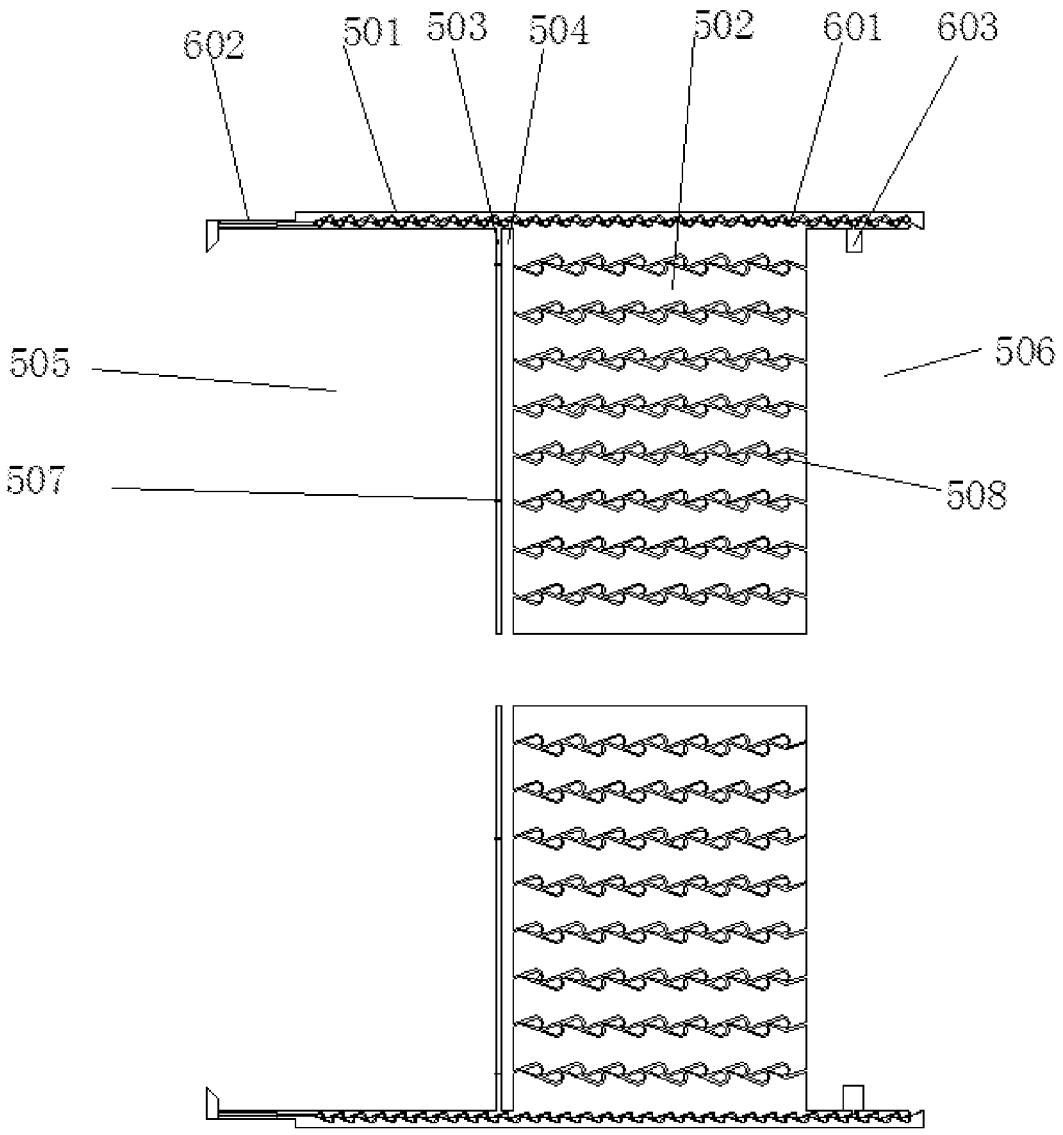
FIG. 5 is a cross-sectional view of the side fairing according to an embodiment of the present invention.
Figure 6:
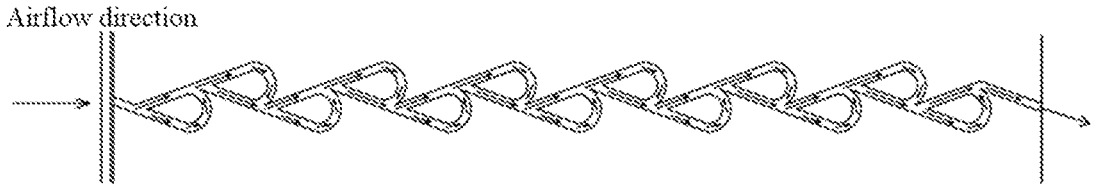
FIG. 6 is a pressure reduction schematic diagram of a pressure reduction hole according to an embodiment of the present invention.
Figure 7:
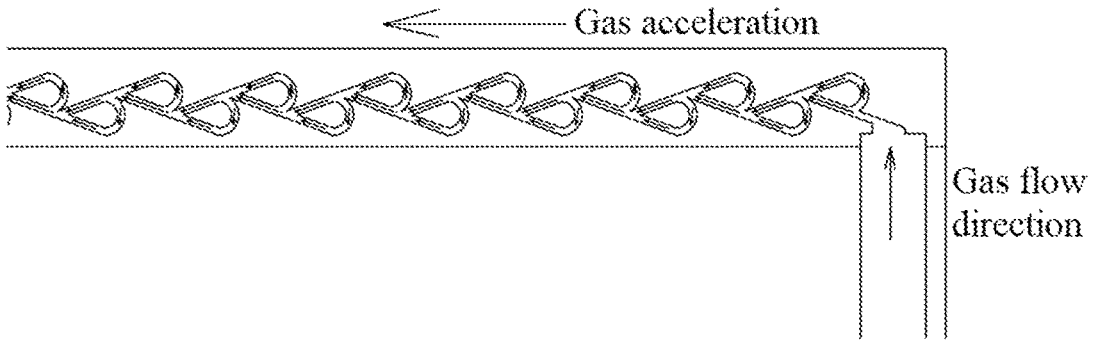
FIG. 7 is an acceleration schematic diagram of a gas acceleration hole according to an embodiment of the present invention.
Figure 8:
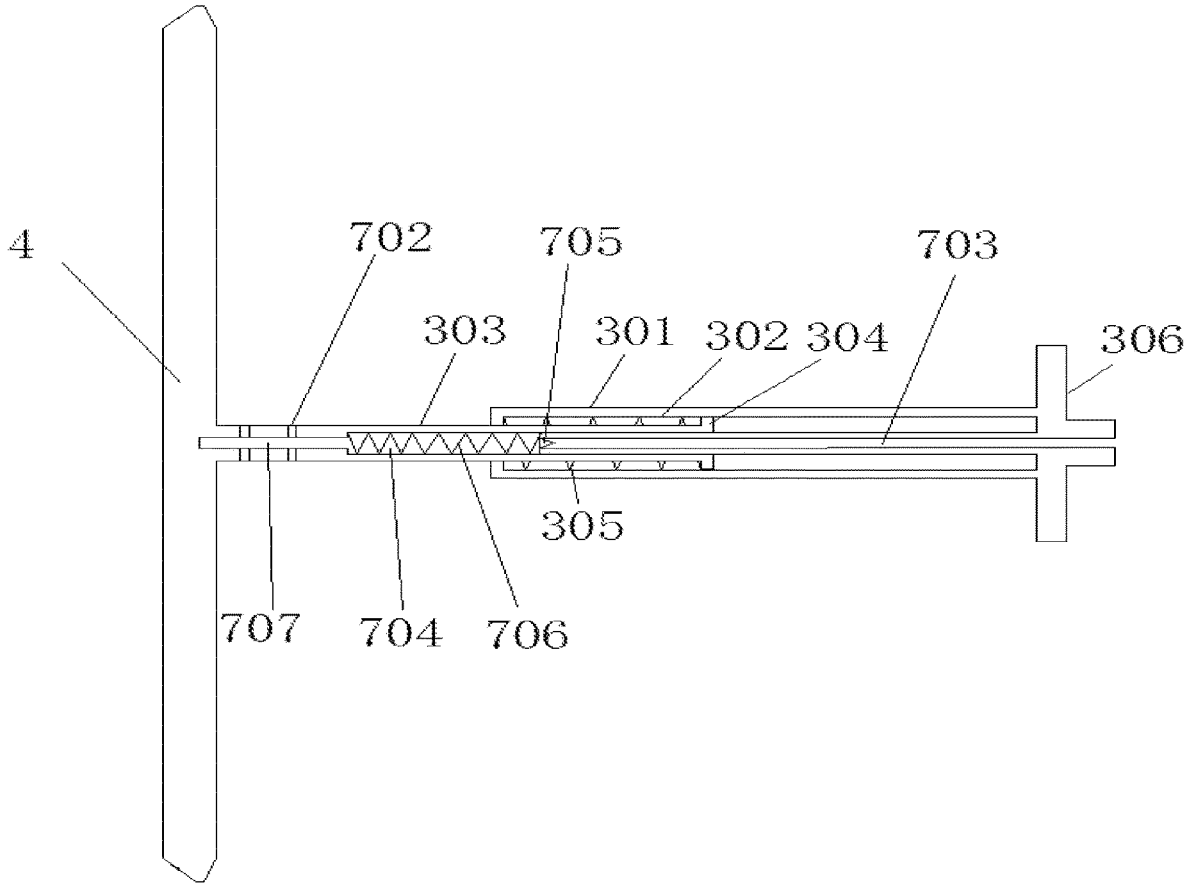
FIG. 8 is a structural schematic diagram of a buffer according to an embodiment of the present invention.
Figure 9:
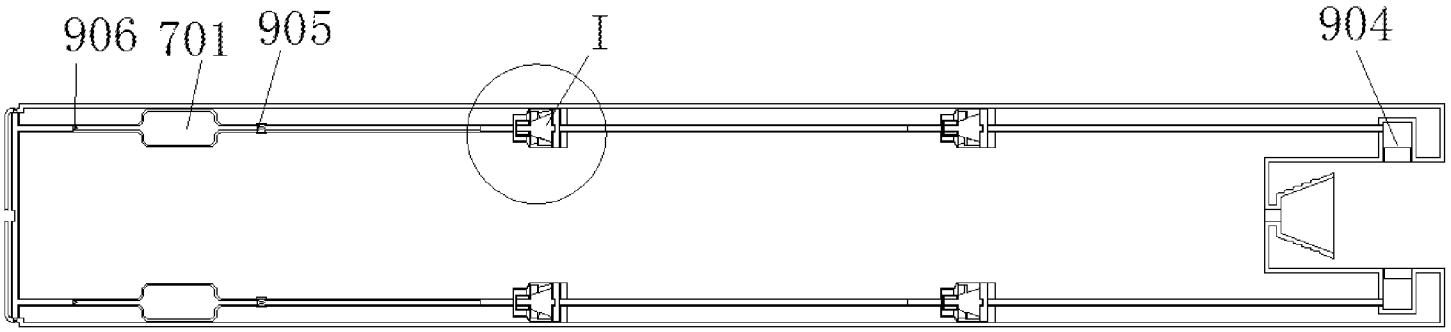
FIG. 9 is a structural schematic diagram of a tail gas collection device according to an embodiment of the present invention.
Figure 10:
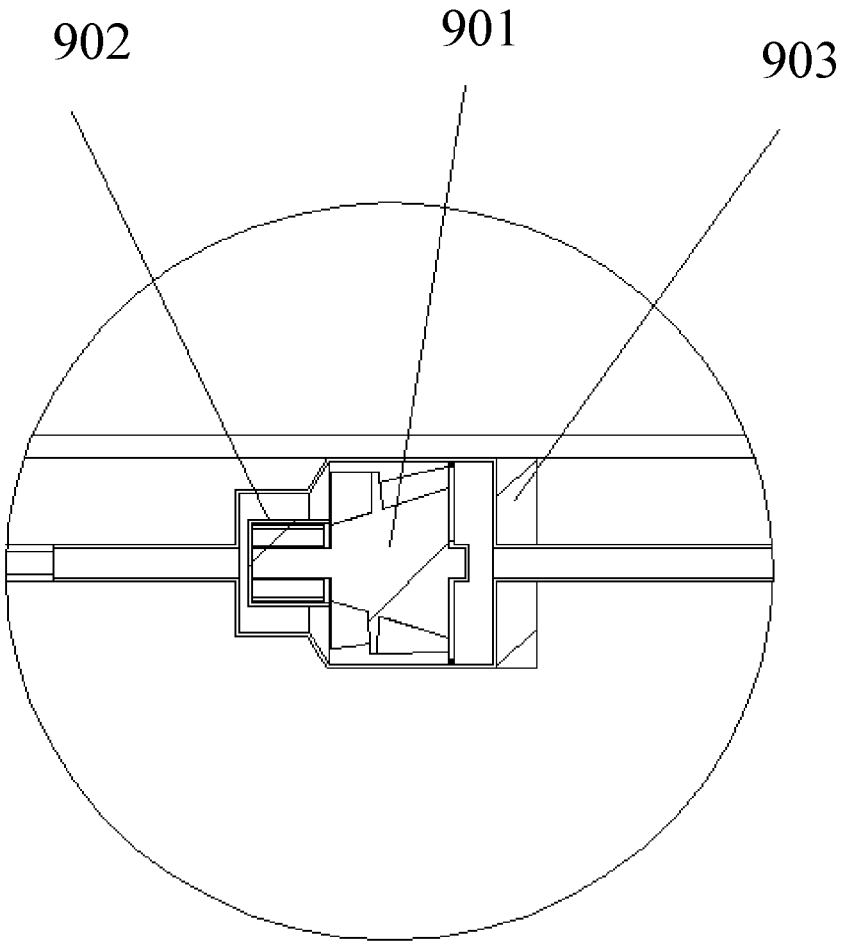
FIG. 10 is an enlarged view of part I of the tail gas collection device in FIG. 9.
Figure 11:
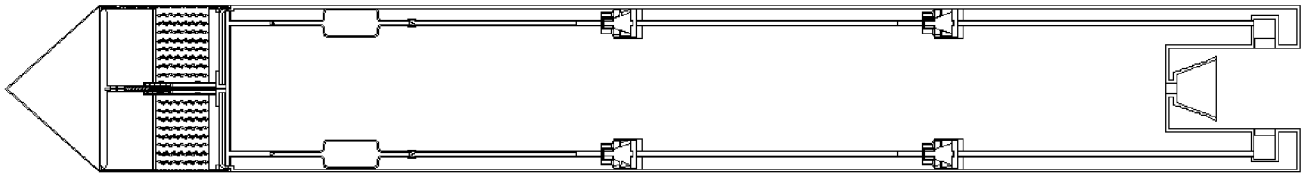
FIG. 11 is a schematic diagram of an underwater vehicle in a normal running state according to an embodiment of the present invention.

In the FIGS. 1—head fairing, 2—underwater vehicle, 3—buffer, 301—outer sleeve, 302—inner sleeve, 303—piston rod, 304—piston, 305—tension spring, 306—damper fixing base, 4—cavitator, 5—side fairing, 501—fairing side wall, 502—fairing body, 503—sealing choke plate, 504—transition cavity, 505—high-pressure gas cavity, 506—sub-high-pressure gas cavity, 507—quota air pressure valve, 508—pressure reducing holes, 6—side wall jet system, 601—gas acceleration hole, 602—gas diffusion ring, 603—gas acceleration hole one-way valve, 604—side jet valve, 7—inflation system, 701—gas storage tank, 702—inflation orifice, 703—central vent tube, 704—gas buffer cavity, 705—inflation valve, 706—compression spring, 707—gas guiding blind hole, 8—booster engine, 9—tail gas collection device, 901—suction fan, 902—driving device, 903—fan air guiding hood, 904—gas cooling and filtering device, 905—gas intake one-way vent valve, 906—gas outtake one-way vent valve.

DETAILED DESCRIPTION OF THE EMBODIMENTS

It should be noted that the embodiments in the present invention and features in the embodiments can be combined without conflicts. The present invention will be described in detail below with reference to the accompanying drawings in conjunction with embodiments.

To make the objectives, technical solutions and advantages of embodiments of the present disclosure more obvious, the technical solutions of the present disclosure will be clearly and completely described below in conjunction with the accompanying drawings in the embodiments of the present disclosure, and obviously, the described embodiments are some, rather than all of the embodiments of the present disclosure. The following description of at least one example embodiment is merely illustrative in nature, and is in no way intended to limit the present disclosure, an application or use thereof. Based on the embodiments of the present disclosure, all other embodiments acquired by those ordinary skilled in the art without making creative efforts fall within the scope of protection of the present disclosure.

It should be noted that the terms used herein are only intended to describe specific embodiments and are not intended to limit the example embodiments of the present disclosure. As used herein, unless indicated obviously in the context, a singular form is also intended to include a plural form. In addition, it should also be understood that the terms "include" and/or "comprise" used in this specification indicate features, steps, operations, devices, components and/or their combinations.

Except as otherwise specifically set forth, the relative arrangement of components and steps, numerical expressions and numerical values set forth in these embodiments do not limit the scope of the present invention. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely example rather than limiting. Therefore, other examples of the example embodiments may have different values. It should be noted that similar reference signs and letters represent similar items in the accompanying drawings below. Therefore, once an item is defined in one accompanying drawing, the item does not need to be further discussed in a subsequent accompanying drawing.

In the description of the present invention, it should be noted that orientations or position relationships indicated by orientation terms "front, rear, upper, lower, left, and right", "transverse, vertical, perpendicular, and horizontal", "top and bottom", and the like are usually based on orientations or position relationships shown in the accompanying drawings, and these terms are only used to facilitate description of the present invention and simplification of the description. In the absence of description to the contrary, these orientation terms do not indicate or imply that the apparatus or element referred to must have a specific orientation or be constructed and operated in a specific orientation, and therefore cannot be understood as a limitation on the protection scope of the present invention: orientation words "inner and outer" refer to the inside and outside relative to the contour of each component.

For ease of description, spatially relative terms such as "on", "over", "on the upper surface", and "above" can be used here, to describe a spatial positional relationship between one device or feature and another device or feature shown in the figures. It should be understood that the spatially relative terms are intended to include different orientations in use or operation other than the orientation of the device described in the figure. For example, if the device in the figure is inverted, the device described as "above another device or structure" or "on another device or structure" is then be positioned as being "below another device or structure" or "beneath a device or structure". Therefore, the exemplary term "above" can include both orientations "above" and "below". The device can also be positioned in other different ways (rotating by 90 degrees or in another orientation), and the spatially relative description used herein is explained accordingly.

In addition, it should be noted that using terms such as "first" and "second" to define components is only for the convenience of distinguishing the corresponding components. Unless otherwise stated, the foregoing words have no special meaning and therefore cannot be understood as a limitation on the protection scope of the present invention.

As shown in FIGS. 1-14, a jet-propelled water-entry composite buffer device 3 for multi-channel gas recycling, includes a head fairing 1, a underwater vehicle 2, a buffer 3 and a cavitator 4, where the buffer 3 is configured to buffer the acting force between the underwater vehicle 2 and the water when the underwater vehicle 2 enters the water, and the device further includes a side fairing 5;

The head fairing 1 is of an integrated structure, made of fragile ceramic-based or organic-based composite materials, and is immediately broken and decomposed by the impact from water entry, and the head fairing 1 is in a conical shape.

The side fairing 5 is a split-type, with a plurality of splits sealing spliced into a whole around the axis of the side fairing 5, and the plurality of splits are detachably connected with each other. The plurality of splits are sealed and fixedly connected, and the joints are designed as a "weak structure", which can be a strong adhesive used to bond the adjacent splits together, or can be a thin plate fixedly connected with the adjacent splits. The weak structure ensures a certain strength, can withstand air resistance during high-speed flight in the air, maintain air-tightness, and no deformation or damage. A wire explosion device and a trigger sensor are installed at each joint between the splits, a detonation device is arranged in the underwater vehicle 2, and the wire explosion device detonates the side fairing 5 to change the integrated structure into splits after the detonation device triggers the trigger sensor.

The side fairing 5 includes a fairing side wall 501, the head part of the underwater vehicle 2 is detachably connected to the rear end of the fairing side wall 501 through electromagnets disposed in the underwater vehicle 2, and the rear end of the head fairing 1 is detachably connected to the front end of the side fairing 5. The cavitator 4 is located in the front end of the fairing side wall 501, and the outer edge of the cavitator 4 is in sealing sliding connection with the fairing side wall 501. There is a cavity between the front end of the cavitator 4 and the head fairing, and the cavity can be filled with a foam cushioning material.

The side fairing 5 further includes a fairing body 502 and a sealing choke plate 503 disposed in the fairing side wall 501. The sealing choke plate 503 is located at the front end of the fairing body 502, a transition cavity 504 is formed by the sealing choke plate 503 and the fairing body located in the fairing side wall 501, a high-pressure gas cavity 505 is formed by the cavitator 4 and the sealing choke plate 503 located in the fairing side wall 501, the high-pressure gas cavity 505 is provided with high-pressure gas, and a sub-high-pressure gas cavity 506 is formed by the fairing body 502 and the head part of the underwater vehicle 2 located in the fairing side wall 501.

The sealing choke plate 503 is provided with a quota air pressure valve 507, and when the pressure in the high-pressure gas cavity 505 exceeds the set value of the quota air pressure valve 507, the high-pressure gas in the high-pressure gas cavity 505 enters the transition cavity 504.

Pressure reducing holes 508 with two ends respectively communicated with the transition cavity 504 and the sub-high-pressure gas cavity 506 are provided in the fairing body 502, and the pressure reducing holes 508 are configured to depressurize and transmit the high-pressure gas in the transition cavity 504 to the sub-high-pressure gas cavity 506.

The output end of the buffer 3 is located in the high-pressure gas cavity 505 and fixedly connected to the cavitator 4, and the input end thereof passes through the sealing choke plate 503 and the fairing body 502 and is connected to the underwater vehicle 2, and is sealing connected to the sealing choke plate 503 and the fairing body 502.

After being pressed, the cavitator 4 compresses the buffer 3 to move backwards, and meanwhile compresses the high-pressure gas in the high-pressure gas cavity 505. When the pressure in the high-pressure gas cavity 505 exceeds the set value of the quota air pressure valve 507, the quota air pressure valve 507 is opened, and the high-pressure gas enters the transition cavity, and then enters the sub-high-pressure gas cavity 506 through the pressure reducing holes 508, preferably the quota air pressure valve 507 is a one-way valve. In this process, in addition to the buffering of the buffer 3, the buffering of the high-pressure gas cavity 505 is further included, which achieves a better buffering effect through the combination of mechanical buffering and gas cushion buffering.

A side wall jet system 6 is disposed on the fairing side wall 501 and includes a plurality of gas acceleration holes 601 axially arranged on the fairing side wall 501, the front end of each gas acceleration hole 601 is communicated with a gas diffusion ring 602 disposed on the outer wall of the front end of the fairing side wall 501, the gas diffusion ring 602 faces the circumferential direction of the side fairing 5, and the rear end of each gas acceleration hole 601 is communicated with the sub-high pressure gas cavity 506 through a gas acceleration hole one-way valve 603. When the pressure in the sub-high-pressure gas cavity 506 reaches a certain value, the gas acceleration hole one-way valve 603 is opened, and the gas in the sub-high-pressure gas cavity 506 rapidly diffuses through the gas diffusion ring 602 under the acceleration of the gas acceleration hole 601, which is conducive to the formation of larger supercavity.

The buffer 3 is provided with an inflation system 7 for inflating the high-pressure gas cavity 505. The inflation system 7 includes an gas storage tank 701 located in the underwater vehicle 2, a gas guiding pipeline system disposed in the buffer 3, and an inflation orifice 702 disposed on the buffer 3. One end of the inflation orifice 702 is communicated with the gas storage tank 701 through the gas guiding pipeline system, and the other end of the inflation orifice 702 is communicated with the high-pressure gas cavity 505.

The buffer 3 includes an outer sleeve 301, and an inner sleeve 302 is disposed in the outer sleeve 301. The part between the outer sleeve 301 and the inner sleeve 302 forms an oil storage cavity. The inner sleeve 302 is provided with a piston rod 303. The front end of the piston rod 303 passes through the outer sleeve and the inner sleeve and is fixedly connected to the cavitator 4 after penetrating the outer sleeve 301 and the inner sleeve 302, and a piston 304 is disposed at the rear end of the piston rod 303. A part between the piston 304 and the front end of the inner sleeve 302 is provided with a tension spring sleeved on the piston rod 303. The rear end of the outer sleeve 301 passes through the sealing choke plate 503 and the fairing body 502 and is fixedly connected with a damper fixing base 306, and is further connected to the underwater vehicle 2 through the damper fixing base 306.

The gas guiding pipeline system includes a central vent tube 703, the front end of the central vent tube 703 sequentially passes through the damper fixing base 306, the rear end center of the outer sleeve 301, and the rear end center of the inner sleeve 302, then penetrates into the piston rod 303 and is in airtight sliding connection with the inner wall of the piston rod 303. The piston rod 303 is internally provided with a gas buffer cavity 704. The rear end of the gas buffer cavity 704 is communicated with the front end of the central vent tube 703 through an inflation valve 705. The gas buffer cavity 704 is provided with a compression spring 706 with an axis coinciding with the axis of the piston rod 303. The end surface of the central vent tube 703 abuts against the compression spring 706. The front end of the piston rod is provided with a gas guiding blind hole 707 communicated with the gas buffer cavity 704, and the gas guiding blind hole 707 is communicated with the inflation orifice 702 processed on the piston rod 303. The rear end of the central vent tube 703 is communicated with the outlet of the gas storage tank 701.

The rear end of each of the gas acceleration holes 601 is communicated with the gas storage tank 701 through a side jet valve 604.

The pressure reducing holes 508 and gas acceleration holes 601 are all Tesla valve holes, and the Tesla valve holes are arranged in the same direction. The structure of the Tesla valve hole is a repetitive unit structure. In the direction of the pressure reducing holes 508 (FIG. 6), the gas will be decelerated once every time when passing through a unit structure. The more the structure is repeated over a finite length (the smaller unit structure), the more obvious the effect on gas deceleration will be. Similarly, in the direction of the gas acceleration holes 601 (FIG. 7), the more the structure is repeated over a finite length (the smaller unit structure), the more obvious the effect on gas acceleration will be.

A booster engine 8 is disposed in the tail part of the underwater vehicle 2, and the tail gas of the booster engine 8 is communicated with the inlet of the gas storage tank 701 through a tail gas collection device 9.

In one implementation, four tail gas collection devices 9 are used, each of the tail gas collection devices 9 is provided with one gas storage tank 701, and includes two sets of structures connected in series, and each set of the structures includes a suction fan 901, a driving device 902 for driving the suction fan 901 to operate, and a fan air guiding hood 903. The suction fan 901 and the drive device 902 are disposed in the fan air guiding hood 903. The driving device 902 is a bearingless permanent magnet motor, and the suction fan 901 is a turbo fan. The two sets of the structures are communicated through a connecting pipeline, the structure located on the rear side is communicated with the exhaust end of the booster engine 8 through a gas cooling and filtering device 904, and the structure located on the front side is communicated with the inlet of the gas storage tank 701 through a gas intake one-way vent valve 905. The gas outtake pipeline at the outlet side of the gas storage tank 701 is provided with a gas outtake one-way vent valve 906, and each of four gas outtake pipelines has two outlet ends, with one end located in the center of the underwater vehicle 2, and the other end located at the outer edge of the underwater vehicle 2. The outlet ends located in the center of the underwater vehicle 2 are converged and communicated with the central vent tube 703, and the outlet end located at the outer edge is communicated with one or more gas acceleration holes 601 through the side jet valve 604.

In working state:

When the booster engine 8 works, the tail gas collection device 9 is controlled and driven by pulse signals to start working, the gas intake one-way vent valve 905 is opened, the gas outtake one-way vent valve 906 is closed, and the tail gas generated by the booster engine 8 is cooled and filtered through the gas cooling and filtering device 904, then inhaled by the suction fan 901 and stored in the gas storage tank 701.

Figure 12:
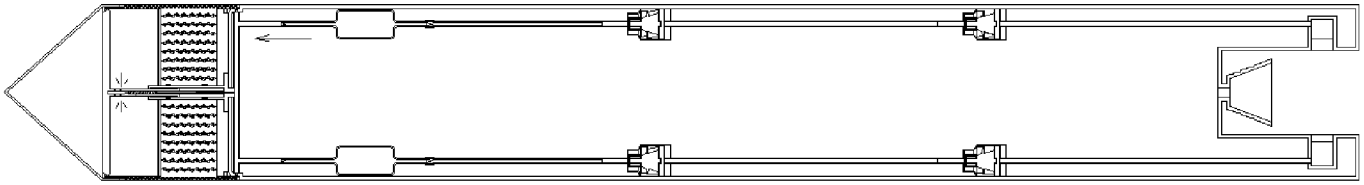
FIG. 12 is a schematic diagram of inflation of an underwater vehicle before entering water according to an embodiment of the present invention.

Before the underwater vehicle 2 hits the water surface, the piston rod 303 of the buffer 3 is in an extended state under the action of the tension spring 305 and hydraulic oil, and the compression spring 706 in extended state provides a displacement space between the gas guiding blind hole 707 and the central vent tube 703. Before the underwater vehicle 2 touches the water surface, the inflation valve 705 and the gas outtake one-way vent valve 906 are opened, the other valves are in the closed state, and the tail gas collected in gas storage tank 701 enters the high-pressure gas cavity 505 through the central vent tube 703, the gas buffer cavity 704, the gas guiding blind hole 707 and the inflation orifice 702. When the pressure in the high-pressure gas cavity 505 reaches a certain value, the inflation is stopped, and the inflation valve 705 and the gas outtake one-way vent valve 906 are closed, as shown in FIG. 12.

Figure 13:
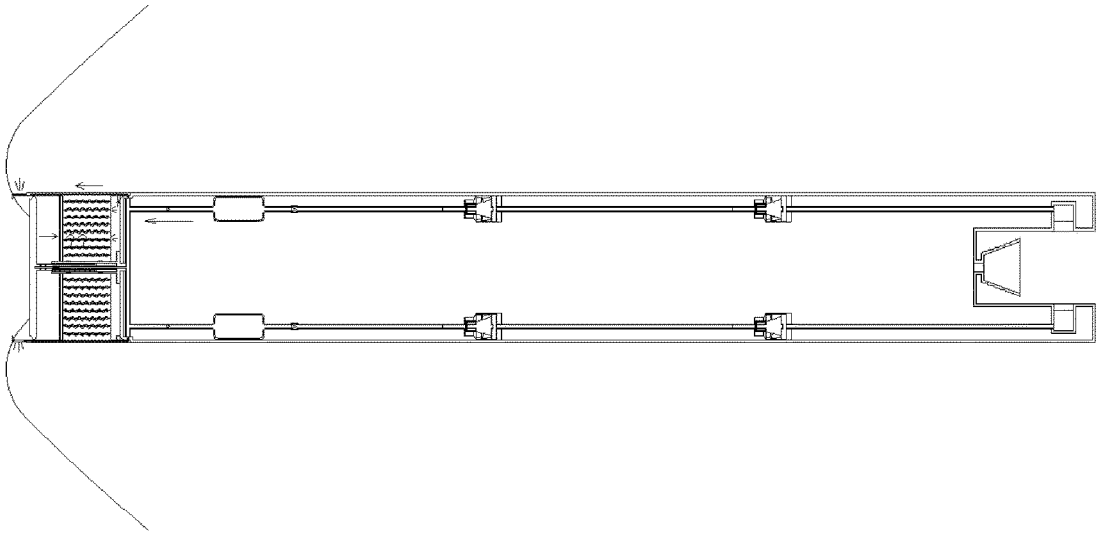
FIG. 13 is a schematic diagram of a buffering process after an underwater vehicle enters water according to an embodiment of the present invention.

When the underwater vehicle 2 touches the water surface, the head fairing 1 is completely broken and decomposed, the cavitator 4 hits the water surface, and under the action of the water pressure, the compression spring 706 is shortened, the tension spring 305 is extended, the piston rod 303 moves rightwards, hydraulic oil is squeezed into the oil storage cavity, and the buffer 3 reduces the load. At the same time, since the high-pressure gas cavity 505 is compressed and shrunk, the gas in the high-pressure gas cavity 505 is further compressed, thereby forming a gas cushion effect, and realizing the load reduction of the underwater vehicle 2. During this process, when the gas pressure in the high-pressure gas cavity 505 reaches a certain value, the quota air pressure valve 507 on the sealing choke plate 503 is opened, the gas flows into the transition cavity 504 and enters the sub-high-pressure gas cavity 506 through the pressure reducing hole 508, and the pressure reducing hole 508 significantly decelerates the gas from the transition cavity 504, so that the gas pressure in the sub-high-pressure gas cavity 506 is lower than that in the high-pressure as cavity 505 and the transition cavity 504, which has a protective effect on the head part of the underwater vehicle 2. When the gas pressure in the sub-high-pressure gas cavity 506 reaches a certain value, the gas acceleration hole one-way valve 603 is opened, and the gas in the sub-high-pressure gas cavity 506 enters the gas acceleration hole 601. Since the side jet valve 604 is closed, the gas can only flow to the front end of the side fairing 5 through the gas acceleration hole 601, the gas acceleration hole 601 accelerates the gas, and the gas is sprayed out circumferentially along the outer side of the side fairing from the micro-porous gas diffusion ring 602, as shown in FIG. 13. The ejected gas significantly expands the diameter of the supercavity during the underwater navigation process of the underwater vehicle 2, which helps to make the underwater vehicle 2 completely wrapped by the supercavity and reduces the navigation resistance. Similarly, the tail gas stored in the gas storage tank 701 can be sprayed out in the circumferential direction from the micro-porous gas diffusion ring 602 along the same gas acceleration hole 601 by opening the side jet valve 604, so as to enhance the capability of opening cavity, which also helps to make the underwater vehicle 2 completely wrapped by the supercavity and reduces the navigation resistance.

Figure 14:
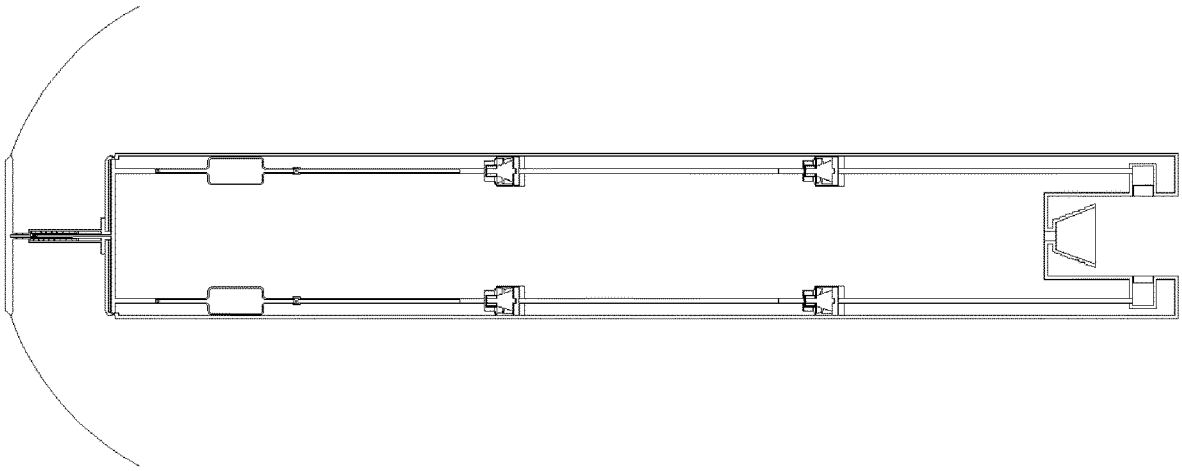
FIG. 14 is a schematic diagram of an underwater vehicle after the side fairing is detached according to an embodiment of the present invention.

After the tail gas in the gas storage tank 701 is exhausted, the electromagnet connecting the side fairing 5 and the underwater vehicle 2 is powered off, the detonation device in the underwater vehicle 2 is activated to control the trigger sensor, and then the wire explosion device at the joint of the side fairing is exploded, resulting in that the side fairing 5 is divided into a plurality of pieces to be separated from the main underwater vehicle. Finally, the cavitator 4 and the buffer 3 connected to the underwater vehicle 2 is remained to navigation, and at this time, the side jet valve 604 is closed to prevent air or water from entering the interior of the underwater vehicle 2, as shown in FIG. 14.

At last, it should be noted that the above various embodiments are merely intended to illustrate the technical solution of the present disclosure and not to limit the same; although the present disclosure has been described in detail with reference to the foregoing embodiments, it should be understood by those ordinary skilled in the art that the technical solutions described in the foregoing embodiments can be modified or equivalents can be substituted for some or all of the technical features thereof; and the modification or substitution does not make the essence of the corresponding technical solution deviate from the scope of the technical solution of each embodiment of the present disclosure.

The invention claimed is:

1. A jet-propelled water-entry composite buffer device for multi-channel gas recycling, comprising a head fairing, an underwater vehicle, a buffer and a cavitator, wherein the buffer is configured to buffer the acting force between the underwater vehicle and the water when the underwater vehicle enters the water, further comprising a side fairing;

wherein the side fairing is a split-type, with a plurality of splits sealing spliced into a whole around the axis of the side fairing, and the plurality of splits are detachably connected with each other; the side fairing comprises a fairing side wall, a head part of the underwater vehicle is detachably connected to a rear end of the fairing side wall, and a rear end of the head fairing is detachably connected to a front end of the side fairing; the cavitator is located in the front end of the fairing side wall, and an outer edge of the cavitator is in sealing sliding connection with the fairing side wall;

the side fairing further comprises a fairing body and a sealing choke plate disposed in the fairing side wall, wherein the sealing choke plate is located at a front end of the fairing body, a transition cavity is formed by the sealing choke plate and the fairing body located in the fairing side wall, a high-pressure gas cavity is formed by the cavitator and the sealing choke plate located in the fairing side wall, the high-pressure gas cavity is provided with high-pressure gas, and a sub-high-pressure gas cavity is formed by the fairing body and a portion of the head part of the underwater vehicle located in the fairing side wall;

the sealing choke plate is provided with a quota air pressure valve, and when the pressure in the high-pressure gas cavity exceeds a set value of the quota air pressure valve, the high-pressure gas in the high-pressure gas cavity enters the transition cavity;

pressure reducing holes with two ends respectively communicated with the transition cavity and the sub-high-pressure gas cavity are provided in the fairing body, and the pressure reducing holes are configured to depressurize and transmit the high-pressure gas in the transition cavity to the sub-high-pressure gas cavity; and an output end of the buffer is located in the high-pressure gas cavity and fixedly connected to the cavitator, and an input end thereof passes through the sealing choke plate and the fairing body and is connected to the underwater vehicle, and is sealing connected to the sealing choke plate and the fairing body.

2. The jet-propelled water-entry composite buffer device for multi-channel gas recycling according to claim 1, wherein a side wall jet system is disposed on the fairing side wall and comprises a plurality of gas acceleration holes axially arranged on the fairing side wall, a front end of each gas acceleration hole is communicated with a gas diffusion ring disposed on an outer wall of a front end of the fairing side wall, the gas diffusion ring faces the circumferential direction of the side fairing, and a rear end of each gas acceleration hole is communicated with the sub-high pressure gas cavity through a gas acceleration hole one-way valve.

3. The jet-propelled water-entry composite buffer device for multi-channel gas recycling according to claim 2, wherein the buffer is provided with an inflation system for inflating the high-pressure gas cavity; the inflation system comprises a gas storage tank located in the underwater vehicle, an gas guiding pipeline system disposed in the buffer, and an inflation orifice disposed on the buffer, one end of the inflation orifice is communicated with the gas storage tank through the gas guiding pipeline system, and the other end of the inflation orifice is communicated with the high-pressure gas cavity.

4. The jet-propelled water-entry composite buffer device for multi-channel gas recycling according to claim 3, wherein the buffer comprises an outer sleeve, an inner sleeve is disposed in the outer sleeve, a part between the outer sleeve and the inner sleeve forms an oil storage cavity, the inner sleeve is provided with a piston rod, a front end of the piston rod passes through the outer sleeve and the inner sleeve and is fixedly connected to the cavitator, a piston is disposed at a rear end of the piston rod, a part between the piston and a front end of the inner sleeve is provided with a tension spring sleeved on the piston rod, a rear end of the outer sleeve passes through the sealing choke plate and the fairing body and is fixedly connected with a damper fixing base, and is further connected to the underwater vehicle through the damper fixing base.

5. The jet-propelled water-entry composite buffer device for multi-channel gas recycling according to claim 4, wherein the gas guiding pipeline system comprises a central vent tube, a front end of the central vent tube sequentially passes through the damper fixing base, a rear end center of the outer sleeve, and a rear end center of the inner sleeve, then penetrates into the piston rod and is in airtight sliding connection with an inner wall of the piston rod, the piston rod is internally provided with a gas buffer cavity, a rear end of the gas buffer cavity is communicated with the front end of the central vent tube through an inflation valve, the gas buffer cavity is provided with a compression spring with an axis coinciding with the axis of the piston rod, an end surface of the central vent tube abuts against the compression spring, the front end of the piston rod is provided with a gas guiding blind hole communicated with the gas buffer cavity, and the gas guiding blind hole is communicated with an inflation orifice processed on the piston rod; a rear end of the central vent tube is communicated with an outlet of the gas storage tank.

6. The jet-propelled water-entry composite buffer device for multi-channel gas recycling according to claim 3, wherein the rear end of each of the gas acceleration holes is communicated with the gas storage tank through a side jet valve.

7. The jet-propelled water-entry composite buffer device for multi-channel gas recycling according to claim 3, wherein a booster engine is disposed in a tail part of the underwater vehicle, and the tail gas of the booster engine is communicated with an inlet of the gas storage tank through a tail gas collection device.

8. The jet-propelled water-entry composite buffer device for multi-channel gas recycling according to claim 7, wherein the tail gas collection device comprises a suction fan, a driving device for driving the suction fan to operate, and a fan air guiding hood, wherein the suction fan and the driving device are disposed in the fan air guiding hood, one end of the fan air guiding hood is communicated with an exhaust end of the booster engine through a pipeline and a gas cooling and filtering device, and the other end of the fan air guiding hood is communicated with the inlet of the gas storage tank through a pipeline and a gas intake one-way vent valve.

9. The jet-propelled water-entry composite buffer device for multi-channel gas recycling according to claim 2, wherein the pressure reducing holes and gas acceleration holes are all Tesla valve holes, and the Tesla valve holes are arranged in the same direction.

* * * * *